US005321915A

United States Patent [19]

Lecerf et al.

[11] Patent Number: 5,321,915

[45] Date of Patent: Jun. 21, 1994

[54] MACHINES FOR GRINDING AND BEVELLING OPTHALMIC LENSES

[75] Inventors: Michel J. M. Lecerf, La Saussaye; Jean-Pierre M. F. Langlois, Rouen, both of France

[73] Assignee: Buchmann Optical Engineering, Ieper, Belgium

[21] Appl. No.: 961,371

[22] Filed: Oct. 15, 1992

[30] Foreign Application Priority Data

Oct. 21, 1991 [FR] France ..... 91 12965

[51] Int. Cl.[5] ..... B24B 17/04

[52] U.S. Cl. ..... 51/165.72; 51/101 LG; 51/284 E; 51/165.71; 51/165.75

[58] Field of Search ... 51/101 LG, 105 LG, 106 EG, 51/284 E, 103 R, 95 R, 165.71, 165.75, 165.72

[56] References Cited

U.S. PATENT DOCUMENTS 4,233,784 11/1980 Loreto ..... 51/106 LG
4,596,091 6/1986 Daboudet ..... 51/101 LG
4,829,715 5/1989 Langlois ..... 51/101 LG

FOREIGN PATENT DOCUMENTS 274860 12/1986 Japan ..... 51/101 LG

*Primary Examiner*—Jack Lavinder
*Attorney, Agent, or Firm*—Martin Smolowitz

[57] ABSTRACT

Machine for grinding and bevelling ophthalmic lenses of the type comprising a carriage movable in translation and in oscillation in directions parallel to and perpendicular to a shaft carrying grinding wheels for edge trimming (4) and bevelling, and a follower (7) for measuring the distance between the plane tangent to the pole of the convex surface of the lens and the edge of the surface and for measuring the value which corresponds to the width of the edge surface (12) of the lens (3). The follower (7) has a surface (8) having a convex curvature identical to that of the grinding wheel and which comprises a matrix of detection elements which cooperate with the edge surface (12) of the lens. Each of the detection elements is connected to a corresponding portion of a sensor (14) to which it transmits a signal representing the passage of a part of the edge surface (12) of the lens in front of the corresponding detection element.

8 Claims, 2 Drawing Sheets

MACHINES FOR GRINDING AND BEVELLING OPTHALMIC LENSES

BACKGROUND OF THE INVENTION

The present invention relates to automatic machines for grinding and bevelling lenses of eyeglasses.

The conventional machines for grinding and bevelling ophthalmic lenses comprise a U-shaped carriage mounted to be slidable and oscillable on a fixed horizontal shaft, a second horizontal shaft mounted to be rotatable perpendicularly between the branches of the U-shaped carriage and comprising two parts between which the lens to be machined is clamped, and a third horizontal rotatable shaft carrying the various grinding wheels for trimming and bevelling the edge surface of the lens blank.

When a blank of an optical lens having a thick edge has been shaped in the shape of the eyeglass frame, the edge surface of the lens has a cylindrical shape and a bevelling operation must be carried out by guiding the lens so as to form on its edge surface a V-section bevel between the edges of its periphery, this bevel being intended to be engaged in the groove of the bezel of the frame.

Effecting such a bevel with a manual control is extremely difficult. Use was made of the "free bevel" system in which the edge surface of the blank is fed into a V-section groove of a grinding wheel and the shaft carrying the lens is left free to move in translation during the grinding operation.

However, this system does not give a fully satisfactory result.

The document FR-A-2 456 304 describes a device for measuring the distance between a given point of the desired contour of an ophthalmic lens and the plane tangent to the pole of the convex surface of this lens. This device comprises an assembly having two followers or tracers one of which cooperates with the lens whereas the other cooperates with the template mounted on the carriage and movable in a direction parallel to the axis of the template and of the lens, one of the followers being in contact with the surface of the lens. As the lens rotates, the follower in contact with the surface of the lens delivers an indication by shifting a pointer in front of a graduated index.

In this device, the fact of contacting only a single point of the lens for a given angle of the latter requires effecting a correction calculation, owing to the fact that the grinding point is displaced differently in accordance with the diameter of the grinding wheel and the non-circular shapes of the frames.

The present invention relates to an automatic machine for grinding and bevelling ophthalmic lenses, of the type comprising a non-mechanical type sensor and in which this correction calculation is unnecessary.

A machine of this type is described and illustrated in the document EP-A-0 281 480 B1 in which a follower or tracer is in contact with the edge surface of the lens and its surface is formed by the adjacent edges of a plurality of movable or vibrating elements adapted to act on sensors responsive to their displacements. However design is not fully satisfactory in that, on one hand, its precision is sometimes insufficient and, on the other hand, there are risks of soiling of the articulation means of the movable elements.

SUMMARY OF THE INVENTION

In order to overcome these drawbacks, the present invention provides a machine for grinding and bevelling ophthalmic lenses of the type comprising a carriage movable in translation and oscillable in directions respectively parallel to and perpendicular to a shaft carrying grinding wheels for trimming and bevelling, and a follower for measuring the distance L1 between the plane tangent to the pole of the convex surface of the lens and the edge of the surface and for measuring the value L2 which corresponds to the width of the edge surface of the lens, characterized in that the follower has a surface having a curvature which is identical to the curvature of the grinding wheel and which comprises a matrix of non-mechanical solid type detection elements which cooperate with the edge of the lens and each of which is connected to a corresponding portion of a sensor to which it transmits a signal representing the passage of a part of the edge surface of the lens in front of the corresponding detection element.

According to other features of the invention:

each detection element is formed by an elementary rectangular portion of the convex surface of the follower, two sides of which are parallel to the axis of the grinding wheel;

the surface of the follower is transparent and continuous and the sensor is an optical sensor constituted by a matrix of photosensitive elementary sensors;

the sensor is constituted by a matrix of elementary sensors each of which is connected to a corresponding elementary portion of the convex surface of the follower through wave transmission means;

a magnifying lens is interposed between the sensor and the surface of the follower for the purpose of forming on the photosensitive side of the sensor an image which is homothetic to that of the surface of the follower;

the machine comprises electronic means for analyzing and converting the signals transmitted to the sensor into data controlling the displacements of the carriage;

the follower is disposed on one side of the grinding wheel, the curvature of the surface of the follower being concentric with that of the grinding wheel;

the follower is movably mounted on the carriage of the machine so as to move in a direction perpendicular to the shaft of the grinding wheel, between a position remote from the edge surface of the lens and an active position close to the edge surface of the lens;

in the active position, the convex surface of the follower is in contact with the edge surface of the lens.

BRIEF DESCRIPTION OF THE DRAWINGS

Further features and advantages of the invention will be apparent from the following detailed description with reference to the accompanying drawings, in which.

DETAILED DESCRIPTION OF EMBODIMENTS

Figure 1:
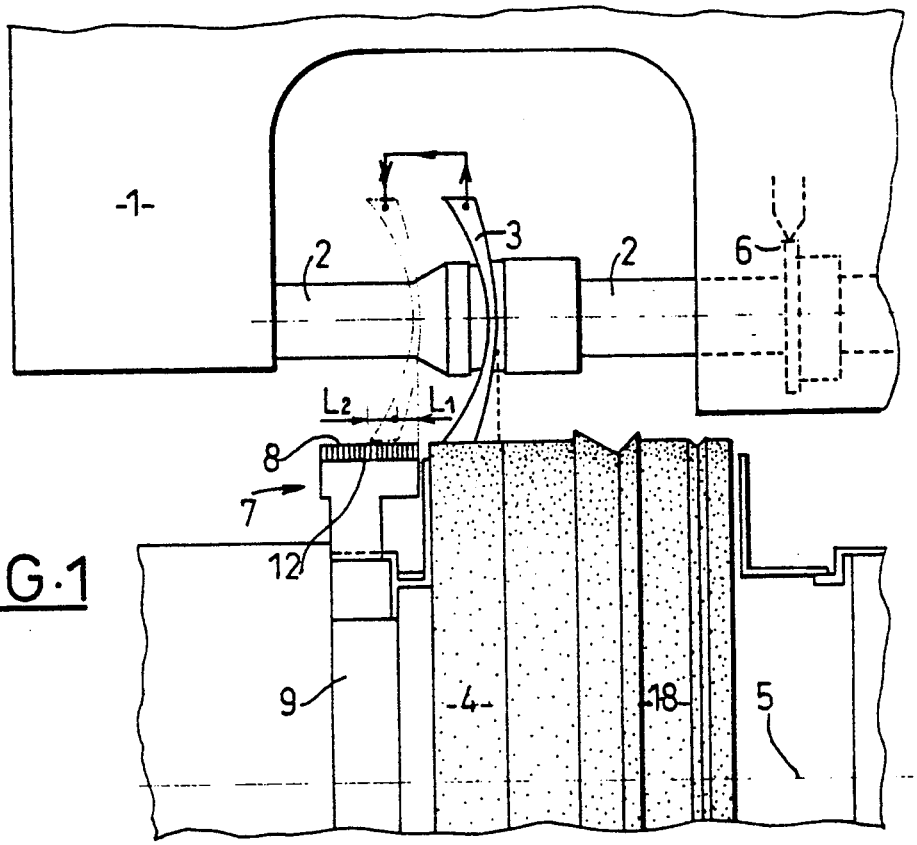
FIG. 1 is a partial diagrammatic view of a grinding and bevelling machine of conventional design to which machine the invention is applied.
Figure 2:
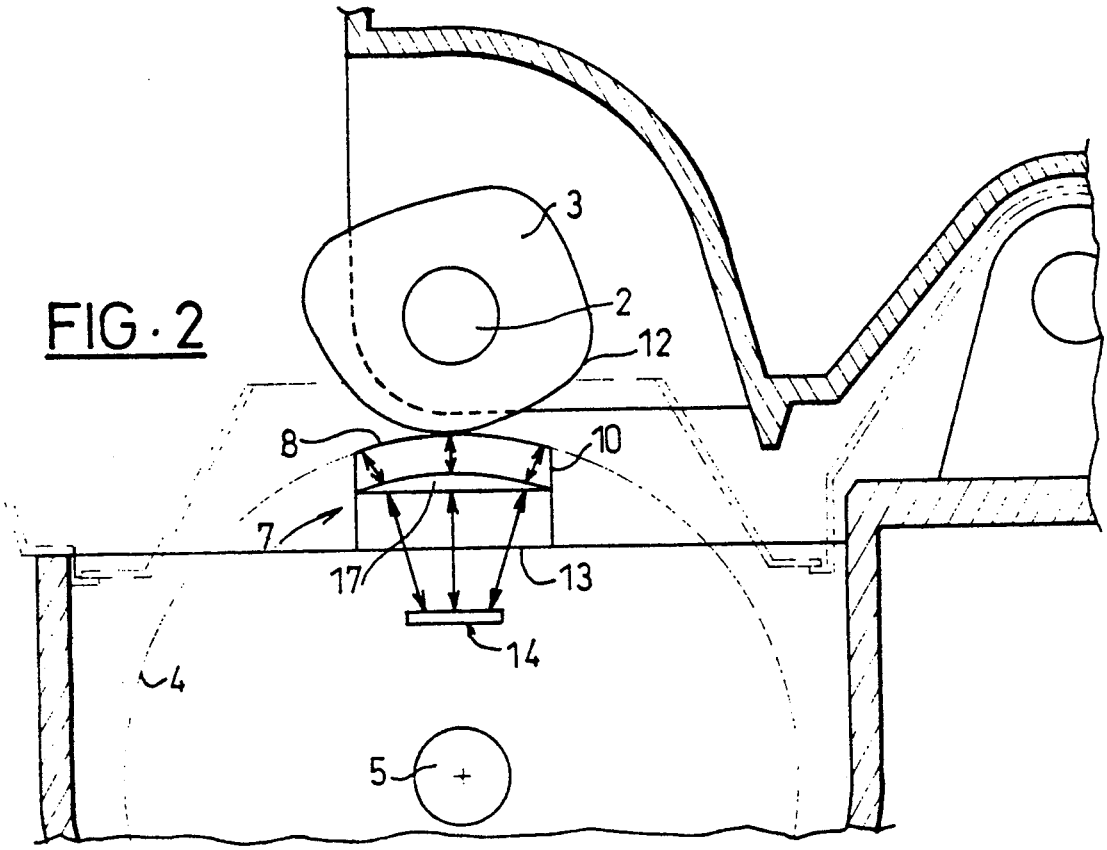
FIG. 2 is an end elevational view of the machine of FIG. 1.

With reference to the drawings and more particularly to FIGS. 1 and 2, a conventional grinding and bevelling machine comprises a U-shaped carriage 1 oscillably mounted on a horizontal shaft (not shown) between the branches of which is rotatably mounted a second horizontal shaft 2 in two parts, between which is clamped a blank 3 of an ophthalmic lens which has been shaped on a grinding wheel 4 rotatably mounted on a third horizontal shaft 5.

As known per se, the machine comprises a sensor 6 detecting the angular position of the lens blank 3 in rotation, and another sensor (not shown) detecting the position of the carriage 1 in translation in a direction parallel to the shaft 2.

In operation, the carriage 1 is lowered so as to bring the blank 3 in contact with the grinding wheel 4.

According to the invention, the machine comprises a follower or tracer, generally designated by the reference character 7, having an outer convex surface 8 with a curvature which is identical to and concentric with the curvature of the grinding wheel 4, and mounted adjacent to the latter on a suitable support 9.

In the embodiment shown in the drawings, the follower 7 is mainly constituted by a block 10 of a material which is optically transparent and radially outwardly defined by the convex curved surface 8, which curvature is identical to the curvature of the grinding wheel 4 and concentric with the latter.

Figure 3:
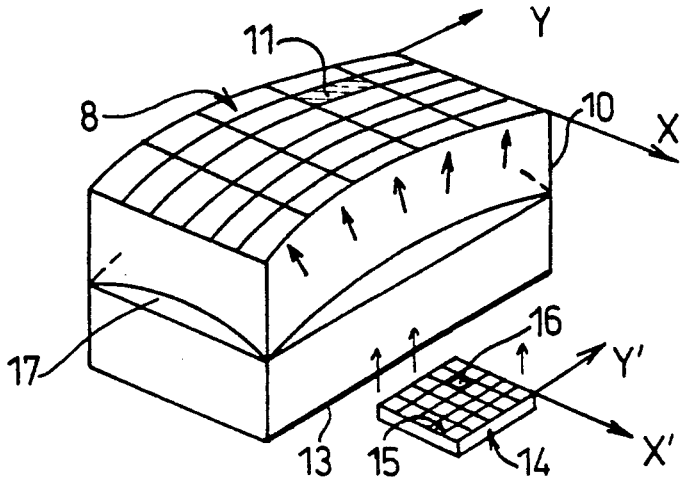
FIG. 3 is a diagrammatic perspective view of the follower.

The convex surface 8 is a portion of a cylindrical surface laterally defined by four sides which are perpendicular to one another and define a follower surface having a rectangular contour. As shown in FIG. 3, the convex surface 8 may be virtually divided into a rectangular network whose sides extend in directions parallel to the axes X and Y, and which are respectively parallel to and perpendicular to the shaft 5 of the grinding wheel 4.

Each mesh element 11 of the network defines a rectangular elementary portion of the convex surface 8 which is consequently constituted by a matrix of detection elements, within the meaning of the invention, in front of which is displaced the edge surface 12 of the lens 3 which may be in contact with the convex surface 8 of the follower or located in the vicinity of this surface The transparent lower face 13 of the block 10 of the follower 7 is arranged in facing relation to a photosensitive sensor 14. The photosensitive surface 15 of the sensor 14 is for example formed by the surface of a sensor of the type CCD sensitive to light and constituted by a matrix of elementary sensors or pixels 16.

The network of the photosensitive surface 15 of the sensor is of course a rectangular network having axes X' and Y' respectively parallel to the axes X and Y. It is indeed the virtual image of the surface 15 on the convex surface 8 of the follower which constitutes the grid of the latter.

The number of mesh elements 11 in convex surface 8 therefore corresponds to the number of meshes 16 and this number determines the precision of the analysis of the follower.

If necessary, a magnifying lens 17 is interposed between the photosensitive surface 15 and the convex surface 8 and is for example integral with the block 10.

It is also possible to know at each moment the number and the position of the mesh elements 11 of the surface 8 in facing relation to which is located a portion of the edge surface 12 of the lens, this data being added to that delivered by the sensor 6 and by the sensor of the displacement of the carriage.

By turning the blank 3 on the follower 7, a series of measurements of L1 and L2 is obtained throughout the periphery of the blank. The corresponding signals stored in a microprocessor then permit a very precise control of the motor feeding the carriage 1 in translation after having placed the edge surface of the blank on the bevelling grinding wheel 18.

Figure 4:
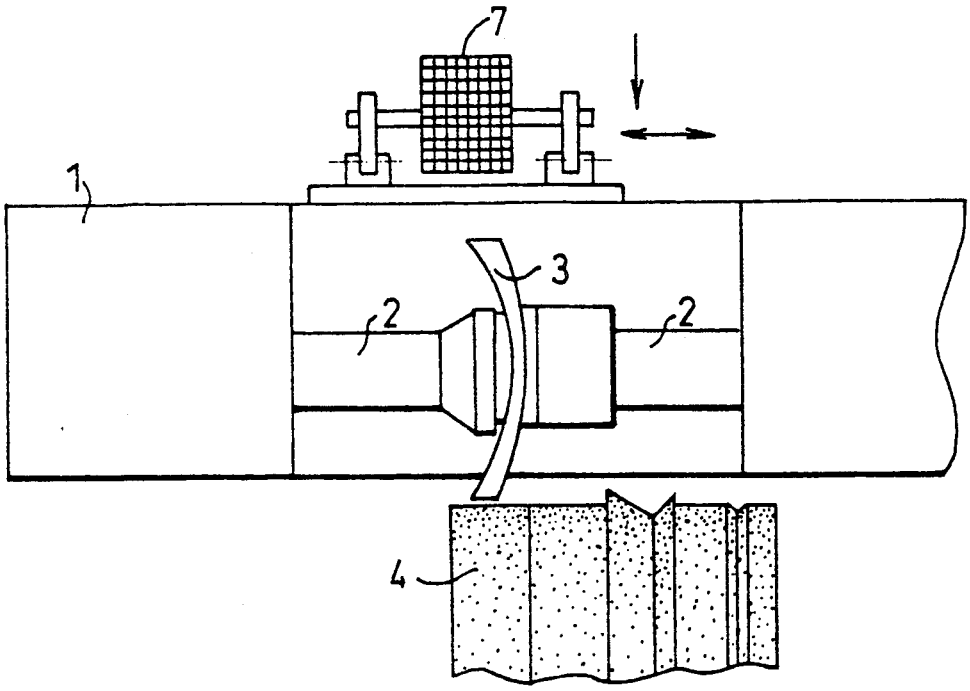
FIG. 4 is a partial diagrammatic view of an alternative embodiment in which the follower is movably mounted on the carriage of the machine.

In an alternative embodiment illustrated in FIG. 4, the follower 7 may be mounted on the carriage 1. However, this embodiment requires an additional mechanism (not shown) for raising and lowering the follower 7 to the active position in contact with or in the vicinity of the edge surface of the lens blank 3.

As will be understood by those skilled in the art, there is of course provided a control of the driving of the carriage in translation for positioning the blank on the follower.

Note also that, owing to the fact that the radius of the follower is identical to that of the grinding wheel, the device takes into account the grinding point and permits taking a reading of a theoretically unlimited quantity of measurements on the whole of the periphery of the lens so that the correction calculation is dispensed with.

It must be stressed that the invention eliminates effecting a free bevelling by directly passing from the shaping stage to the guided bevelling stage, although it permits effecting a free bevelling if desired.

It must be understood that the scope of the invention is not intended to be limited to the use of a sensor of the photosensitive type, but may also encompass the use of non-mechanical detection and transmission means of the radar or sonar type, i.e. generally employing reflected waves for transmitting signals representing the presence or the absence of a portion of the edge surface of the lens facing the surface of the follower, it being possible for the latter to be itself virtual.

What is claimed is:

1. A machine for grinding and bevelling opthalmic lenses, said machine comprising in combination: a rotatable shaft, edge trimming and bevelling grinding wheels mounted on said shaft, a carriage movable in translation and in oscillation in directions respectively parallel to and perpendicular to said shaft, and a follower for measuring a distance $L_1$ between a plane tangent to the pole of the convex surface of an opthalmic lens and the edge of said convex surface, and for measuring a value $L_2$ which corresponds to the width of the edge surface of the lens, said follower having an outer convex surface having a curvature which is identical to the curvature of the periphery of said grinding wheel, said follower further comprising a matrix of non-mechanical detection elements which are cooperative with the edge surface of said lens, a sensor, each of said detection elements being connected to a corresponding elemental portion of said sensor to which portion it transmits a signal representing the passage of a part of the edge surface of the opthalmic lens in front of the corresponding detection element; said sensor including a matrix of elementary sensors and having wave transmission means connecting each of said elementary sensors to a corresponding detection element portion of said convex surface of said follower.

2. Machine according to claim 1, wherein each detection element is constituted by a rectangular elementary portion of said outer convex surface of said follower, two sides of which elementary portion are parallel to said shaft.

3. Machine according to claim 1, wherein said sensor is constituted by a matrix of elementary sensors, wave transmission means connecting each of said elementary sensors to a corresponding elementary portion of said of said follower.

4. Machine according to claim 1, comprising electronic means for analyzing and converting said signals transmitted to said sensor so as to convert said signals into data for controlling displacements of said carriage.

5. Machine according to claim 1, wherein said follower is disposed on one side of said grinding wheel, the curvature of said surface of said follower being concentric with said surface of the periphery of said grinding wheel.

6. Machine according to claim 1, wherein said follower is movably mounted on said carriage for moving in a direction perpendicular to said shaft between a position remote from said edge surface of said lens and an active position close to said edge surface of said lens.

7. A machine for grinding and bevelling opthalmic lenses, said machine comprising in combination: a rotatable shaft, edge trimming and bevelling grinding wheels mounted on said shaft, a carriage movable in translation and in oscillation in directions respectively parallel to and perpendicular to said shaft, and a follower for measuring a distance $L_1$ between a plane tangent to the pole of the convex surface of an opthalmic lens and the edge of said convex surface, and for measuring a value $L_2$ which corresponds to the width of the edge surface of the lens, said follower having an outer convex surface having a curvature which is identical to the curvature of the periphery of said grinding wheel, said follower further comprising a matrix of non-mechanical detection elements which are cooperative with the edge surface of said lens; said outer convex surface of said follower being transparent and continuous, and including an optical sensor, each of said detection elements being connected to a corresponding portion of said optical sensor to which portion it transmits a signal representing the passage of a part of the edge surface of the opthalmic lens in front of the corresponding detection element.

8. Machine according to claim 7, comprising a lens interposed between said sensor and said surface of said follower for forming on the photosensitive surface of said sensor an image which is homothetic to the image of said surface of said follower.

* * * * *